United States Patent [19]

Engebretsen

[11] 3,962,964

[45] June 15, 1976

[54] COMPACTOR CYCLE CONTROL

[75] Inventor: Einar O. Engebretsen, Troy, Ohio

[73] Assignee: Hobart Corporation, Troy, Ohio

[22] Filed: Sept. 17, 1974

[21] Appl. No.: 506,695

[52] U.S. Cl. ..... 100/51; 100/53; 100/215; 100/229 A

[51] Int. Cl.[2] ..... B30B 15/14

[58] Field of Search ..... 318/285; 307/141; 100/51, 43, 48, 53, 229 A, 215; 425/155, 156, 157

[56] References Cited

UNITED STATES PATENTS

| | | | |
|---|---|---|---|
| 3,070,003 | 12/1962 | Stacy | 100/51 |
| 3,108,533 | 10/1963 | Read et al. | 100/51 |
| 3,613,558 | 10/1971 | Math | 100/52 X |
| 3,714,890 | 2/1973 | Moon | 100/229 A |
| 3,720,844 | 3/1973 | Sahs | 100/52 UX |
| 3,756,144 | 9/1973 | Engebretsen | 100/229 A |
| 3,805,084 | 4/1974 | Schuerman et al. | 100/52 |
| 3,827,350 | 8/1974 | Gilman | 100/52 |
| 3,831,513 | 8/1974 | Tashman | 100/53 X |
| 3,869,978 | 3/1975 | Steinberg et al. | 10/51 X |

*Primary Examiner*—Billy J. Wilhite
*Attorney, Agent, or Firm*—Biebel, French & Nauman

[57] ABSTRACT

A compacting machine has a reversible induction motor drive for a ram movable in a cycle consisting of a compacting stroke, followed by a sustained dwell period, and a retracting stroke. Directional controls prepare the drive for a compacting stroke when the ram is at its fully retracted starting position and prepare the drive for a retracting stroke as soon as the ram leaves the starting position. When the ram encounters a predetermined resistance the drive automatically reverses. The ram is stopped at this time, and later is moved through its retracting stroke to complete a full cycle. Circuits are disclosed to retract the ram automatically after a lapse of time, or under manual control. A selector is also provided to make this feature optional by choice of the operator.

4 Claims, 6 Drawing Figures

COMPACTOR CYCLE CONTROL

CROSS REFERENCE TO RELATED APPLICATIONS

This application is related to U.S. application Ser. No. 506,696, entitled TRASH COMPACTOR WITH CLOCK TIMER CONTROL, filed concurrently with this application and assigned to the same assignee.

BACKGROUND OF THE INVENTION

This invention relates to trash compacting machines and the like, and particularly to the controls for a reversible electric motor, preferably an induction motor, driving a compacting ram in such a machine. Controls for the motor include a starting circuit with a manually operable starting switch which is closed to establish the power supply to the motor, as disclosed in U.S. Pat. Nos. 3,805,084 and 3,808,453. A directional switch is responsive to ram location at its retracted limit, also the cycle starting position, and is moved to cause forward (compacting) motor generation when the ram is at this position. When the ram leaves its starting position the directional switch transfers to reverse or retracting connections preparatory to any slowing of the motor to a speed where its centrifugal starting switch will again close.

A cycle ending switch is arranged to respond to ram movement as the ram approaches its starting position, at which time this switch is actuated and power to the motor is terminated as the ram approaches the starting position at the end of the retracting stroke. The ram and motor may coast to a stop, but once the starting position is reached, the directional switch is moved to the forward starting position.

A safety door interlock switch and a key switch are provided to assure that the machine can be operated only with the mechanism properly enclosed and protected, and only by authorized persons. The motor circuit includes overload protection and a manually operable stop switch. If any of these switches breaks the power supply to the motor after a compacting stroke has begun, immediately upon restoration of the power the motor normally will start in the reverse direction and retract the ram to its starting position.

It has been observed that trash subjected repetitively, but not in any particular sequence, to this type of compaction, will exhibit some tendency to rebound or expand after release of compacting pressure. Tests made by stopping the ram at its position of maximum force, where the motor stalls, have been made using the manual stop switch to turn off power to the motor at that time. The results of these tests indicate that by extending the period of time during which maximum force is exerted on the trash, the amount of rebound is substantially reduced, depending of course on the type of trash being compacted. However, beneficial results did not appear to be increased appreciably if this time period was extended beyond about thirty minutes. For example, application of continued force for as long as eight to twelve hours did not produce a really different result than the half-hour period.

Since it is necessary to have the ram retracted when loading the receptacle, an automatic or semi-automatic control for extending the period of high force compression is desirable. Especially is this so in connection with domestic models of trash compactors, where simplified operation is always desired.

SUMMARY OF THE INVENTION

The present invention provides several embodiments of control circuits which cause the ram to remain in position within the receptacle, at the end of the compacting stroke, for a period of time, and then cause the ram to withdraw either automatically or on manual demand. In addition, a selector switch preferably is included, connected to make this feature a manually selected option.

The principal object of the invention is thus to provide such a compacting machine with a control of the above described type, in which a compacting cycle is automatically delayed at the end of the compacting stroke, and after a delay of a predetermined period, e.g. thirty minutes, proceeds to complete the full cycle; in which, following a predetermined delay after stopping of the ram, subsequent retracting ram movement will occur automatically; in which the delay prior to ram retraction can be eliminated from the machine cycle if desired; and in which the desired delay, under compacting pressure can be accomplished with a relatively inexpensive induction motor drive.

Other objects and advantages of the invention will be apparent from the following description, the accompanying drawings and the appended claims.

Description of The Preferred Embodiments

Figure 1:
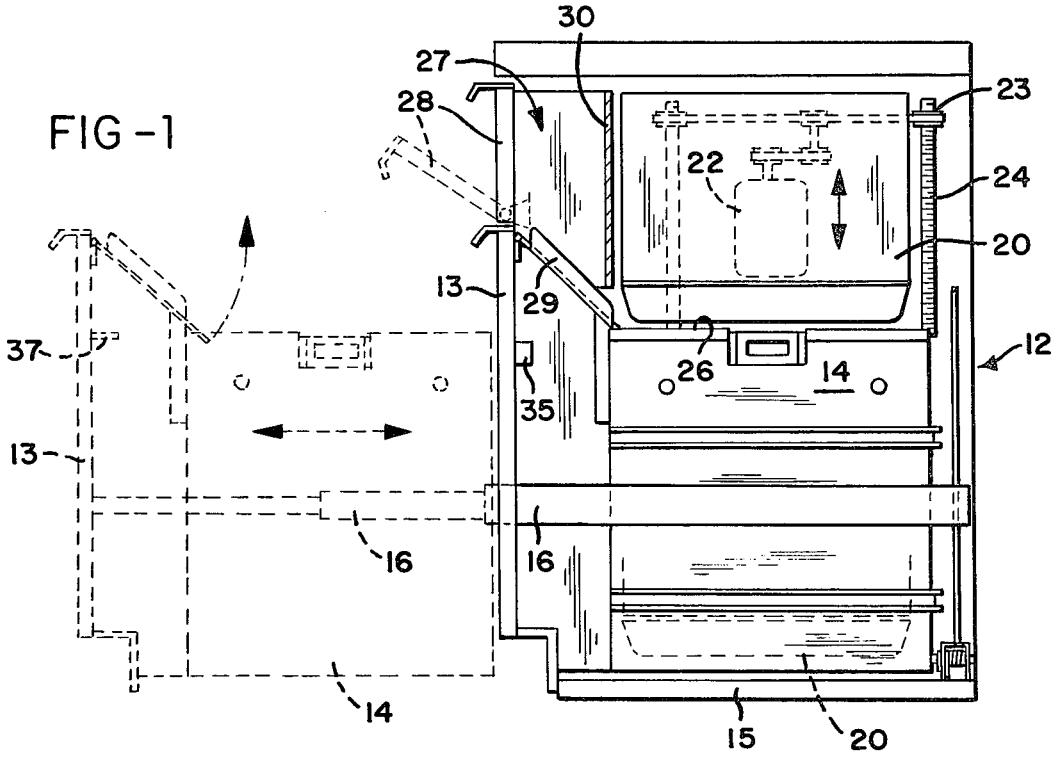
FIG. 1 is an internal side view of the compactor, showing the receptacle thereof in full lines in position for compacting, and in dotted lines in a noncompacting position; and with the ram shown fully retracted in full lines, and in a compacting position in dotted lines.

As seen in FIG. 1 of the drawings, the compactor includes an upstanding housing 12 having a reciprocating door 13 behind which a receptacle 14 is located over the base 15. As shown in FIG. 1, the door 13 and receptable 14 may take the form of a drawer unit mounted on slides 16 for movement between a compacting position fully within the housing 12 and a noncompacting or loading position outwardly of the housing, as shown in dotted lines in FIG. 1. A ram 20 is also positioned in the housing and carries a motor 22 which, through a suitable drive chain such as shown in U.S. Pat. No. 3,734,009, drives sprockets 23 to cause the entire ram mounted assembly to move upwardly and downwardly along the stationary jack screws 24.

Thus, the ram is movable between a retracted position (solid lines) wherein its lower surface clears an upper edge 26 of the receptacle, permitting the receptacle to be moved outwardly to a position where loading and unloading can occur, and a compacting position (dotted lines) within said receptacle when the receptacle is fully positioned with the housing 12.

The drive motor 22 for the ram is provided with a starting and reversing control (FIG. 3) which will automatically initiate a cycle consisting of a compacting stroke of the ram, and a subsequent retracting stroke to the starting position. The compacting stroke ends after some predetermined load is imposed on the motor as it drives the ram in the compacting stroke. When the ram is away from its starting position the receptacle may be locked in the housing. Mechanism for this purpose is shown in U.S. Pat. No. 3,807,295 (Ser. No. 224,897, filed Feb. 9, 1972).

While the receptacle 14 is locked in position during initial compacting movement of the ram, access may still be had to a storage compartment 27 of the compactor through the upper access door 28. Waste material, particularly, small items such as milk cartons, bottles, cans, etc., can be deposited in the compactor, where they will rest in a small compartment formed by the inclined shelf 29 and the protective wall 30, until such time as the receptacle 14 is moved outwardly of the housing. This will allow articles lying on shelf 29 to fall into the receptacle 14. The user, therefore, need not wait until the receptacle is unlocked, or until the ram is fully retracted, to deposit material in the compactor, but he is of course protected against injury, etc., by wall 30 and shelf 29 during operation of the ram.

A safety interlock switch 35, is mounted inside the front of the housing, as seen in FIG. 1, and is engaged by a pin 37 when the receptacle 14 is in its compacting position.

A further interlock is provided by the normally closed switch 40 which is wired in parallel with switch 35. Switch 40 is operated by an arm (not shown) carried by ram 20, and arranged such that the switch is opened until the ram lower surface is just below or within the upper edge 26 of the receptacle, for example within about one inch of the edge 26. In other words, switch 40 is closed only when the ram has entered the receptacle and thus acts to prevent the drawer unit from being opened, intentionally or accidentally.

Figure 2:
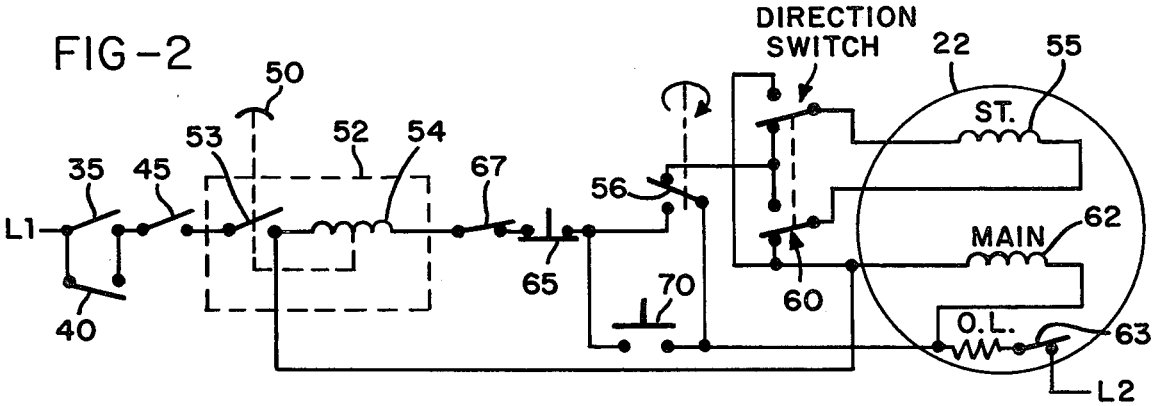
FIG. 2 is a representation of a control circuit for one embodiment of the present invention.

Referring to FIG. 2, one embodiment of the control system is shown. Interlock switch 35 is closed only when drawer 14 is closed, and it controls all power to the unit together with key switch 45. Contacts are shown in the position with the drawer open, the ram up, motor stopped, and the key safety switch open. With the key switch 45 operated to close, and the drawer closed, pushing the start button 50 on relay 52 will close its contact 53 and apply power to the starting winding 55 of ram motor 22, through the motor's centrifugal starting switch 56, and through the contacts of a directional switch 60. A power circuit is also completed to main winding 62. The overload protector 63 is included in these circuits as protection for the motor.

The holding circuit for relay 52 includes its coil 54, manual stop switch 65 which is normally closed, a normally closed ram operated switch 67, and the normally open (when stopped) contacts of centrifugal switch 56. Switch 67 is arranged to be opened momentarily by the ram only when it is nearing the top of its return stroke. This can be accomplished as disclosed in the related application Ser. No. 279,985 now U.S. Pat. No. 3,808,453. On the compacting stroke switch 67 is unaffected and remains closed, but on the upward retracting stroke the switch is momentarily opened just as the ram approaches its fully retracted position. Directional switch 60 is carried by the ram and is held in the position shown only when the ram is fully up. When the ram is in any other position, the blades of switch 60 transfer to the contacts shown open.

Thus, as power is first applied the motor 22 starts in a direction to lower the ram in a compacting stroke. The motor immediately comes up to speed, since it is under only a slight load, and switch 56 transfers to seal in relay 52. However, transferring of the contacts of switch 60 has no effect on motor direction. This change in the direction switch prepares the circuit for reversing the motor as soon as the compaction stroke is resisted enough to slow the motor to a speed where switch 56 closes.

A manually operable selector switch 70 is connected across the normally open contacts of centrifugal switch 56. In its closed position, switch 70 bypasses these normally open contacts and the motor immediately reverses, withdrawing the ram, and near the end of the upward stroke switch 67 momentarily opens, deenergizing coil 54 of the starting relay. The motor coasts to a stop past the actuation position of switch 67, so that it again closes. Switch 60 is moved to the position shown, such that the circuit is ready for the next compacting stroke, just before switch 67 is actuated. In this mode of switch 70 the delay at the end of the compacting stroke is eliminated.

After a compacting stroke begins switch 40 closes, bypassing interlock switch 35 since the ram is now inside the receptacle. Thereafter, if stop switch 65, or key switch 45, is opened, or the motor overload protector 63 opens, the circuit energizing relay 52 will be broken, and the motor will stop.

If selector switch 70 is opened, when the ram halts at the end of its compacting stroke, the power supply circuit to the motor will be opened since centrifugal switch 56 has transferred to its normally closed contact, and this breaks the holding circuit for relay 52. The ram maintains pressure on the trash in the container until the selector switch is closed and the start button 50 is again actuated. Then the holding circuit will be re-established and the motor will start in a direction to raise the ram, as previously explained. Thus, the selector switch 70 can be said to have up (closed) or down (open) positions which correspond to where the ram is stopped after it begins a compacting operation.

Figure 3:
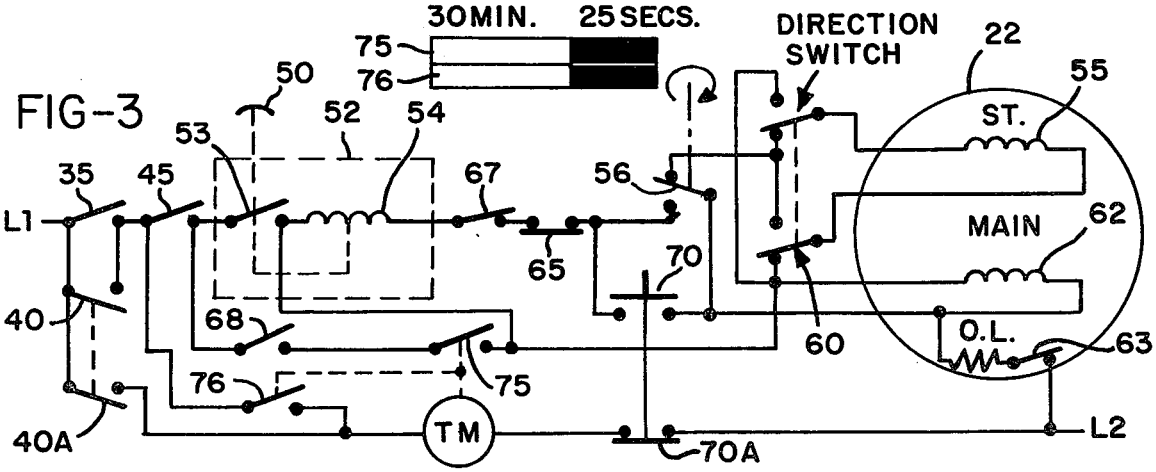
FIGS. 3–6 show other control circuits for other embodiments of the invention.

A modification of the control is shown in FIG. 3. The same reference numerals are applied to identical parts. The basic difference is that the control of FIG. 3 provides for a predetermined period of time during which the ram holds at the end of its compacting stroke, after which the ram automatically retracts to its normal starting position withdrawn from the receptacle.

In this modification a timer having a motor TM is connected in a secondary control circuit which includes a separate set of contacts 40A (normally open) of the bypass switch 40, and a normally closed set of contacts 70A which are part of the selector switch 70. Thus the timer motor is driven only if the ram has entered the receptacle and the selector switch is in its down position.

The timer controls a set of normally open timed contacts 75 which are connected across manual start switch 53 of the relay and normally open contacts 76 which are connected across the bypass switch 40, 40A. With the selector switch in its down position, manual closing of start switch 53 will lock in the start relay and the ram will descend until the motor stalls, then stop as before. Once the ram enters the receptacle switch contacts 40A close and the timer starts its term. A typical timer term is in the order of thirty minutes (see chart in FIG. 3), after which the compressed trash will tend to remain as compacted when the ram force is stopped.

When the timer runs out its term, it closes its contacts 75 and 76, and this closes a starting circuit around the relay coil 54, contact 53, RAM switch 68, and through the normally closed contact of switch 56. The motor starts in the reverse or retracting mode, and the centrifugal switch 56 transfers, the timer contacts 75 being maintained closed until the ram is retracted as previously explained. As the ram proceeds through its retracting stroke, power to the timer motor continues through contacts 76 even when the ram moves outside the receptacle and switch 40, 40A opens, until the normally closed ram switch 68 is opened when the ram is fully retracted. Timer contacts 76 remain closed for a sufficient time for the timer to reset, opening its contacts 75 and 76, which will not affect the remaining circuits.

Figure 4:
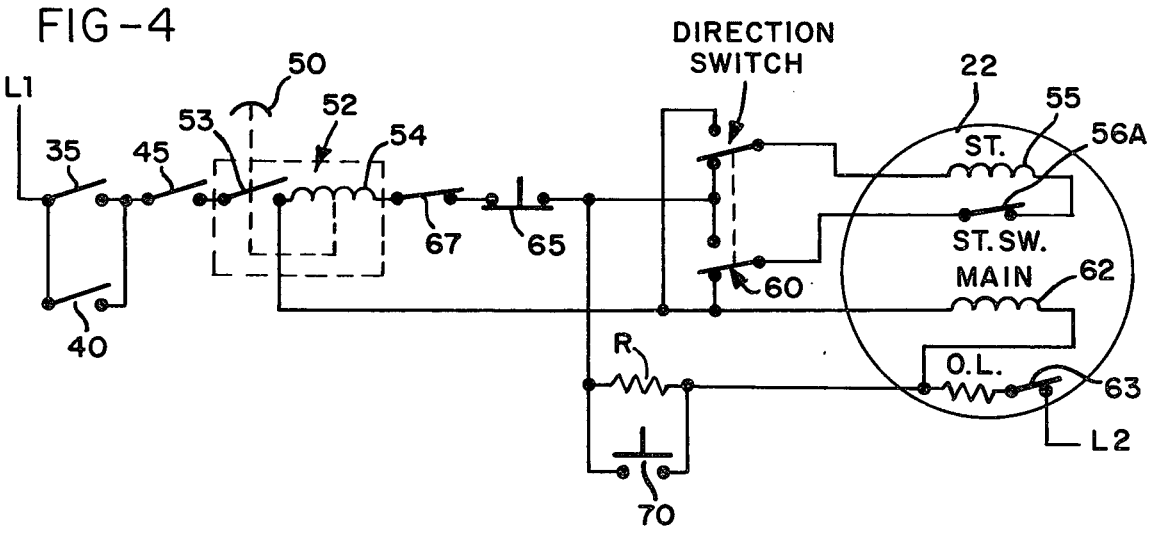

A further embodiment of the invention is illustrated in the circuit shown in FIG. 4. Again, identical parts are illustrated with the same reference numerals. Here, the selector switch 70 is connected across a resistor R, and this parallel circuit is connected in series with the relay holding circuit including a relay coil 54, stop switch 65, the termination switch 67, and the overload protector 63. The value of resistance R is selected such that the voltage drop across it will be sufficiently small to keep the relay 52 energized when the motor is in its running condition. In one embodiment a 3 ohm 10 watt resistor was used in a 120 volt circuit with a 1/2 horsepower induction motor and a relay having a drop-out voltage in the order of 60–80 volts. During the starting mode (in either direction) a parallel circuit exists from the start relay coil 54, RAM switch 67, stop switch 65, and through the direction switch 60 and the starting circuit including centrifugal switch 56A and the start winding 55 in series with resistor R. In effect this is a voltage dividing network and at that time the voltage drop across the branch of the circuit including resistance R and relay coil 54 is insufficient to hold the relay in its energized position.

During manual starting, depression of the start button 50 holds the relay switch 53 closed, and the motor starts rapidly since it is under a light load. Within a fraction of a single rotation, the motor accelerates sufficiently to open the centrifugal switch 56A and there is no perceptible need to hold the start button 50 depressed for an extended period of time. This has been observed in actual operation.

However, when the ram reaches the end of its compacting stroke and the motor is in a stalled condition, centrifugal switch 56A closes, and almost instantaneously the voltage drop across resistor R increases to the point where the relay 52 drops out, its switch 53 opens and the motor stops. In this condition the ram maintains pressure on the compacted trash. To raise the ram, it is necessary merely again to depress the start button 50 long enough for the motor to accelerate. The direction switch 60, as will be recalled, moved to the reverse condition as soon as the ram left is fully retracted position. Therefore the reverse circuit is in effect and the motor is started in a direction to retract the ram, acting only against the frictional forces in the mechanism connecting the motor to the ram. The motor therefore accelerates quickly, centrifugal switch 56A opens and the relay holding circuit seals in the relay 52 until the ram is almost fully retracted, and the cycle ending switch 67 is opened momentarily, as previously explained.

If a normal cycle of operations is desired, the selector switch 70 is closed, shunting the resistor R and allowing the circuit to function in the normal complete cycle mode in which the motor is immediately restarted in reverse after it slows sufficiently under load to close the centrifugal switch 56A. The timed function can be added to the circuit shown in FIG. 4, in the same manner as illustrated in FIG. 3.

Figure 5:
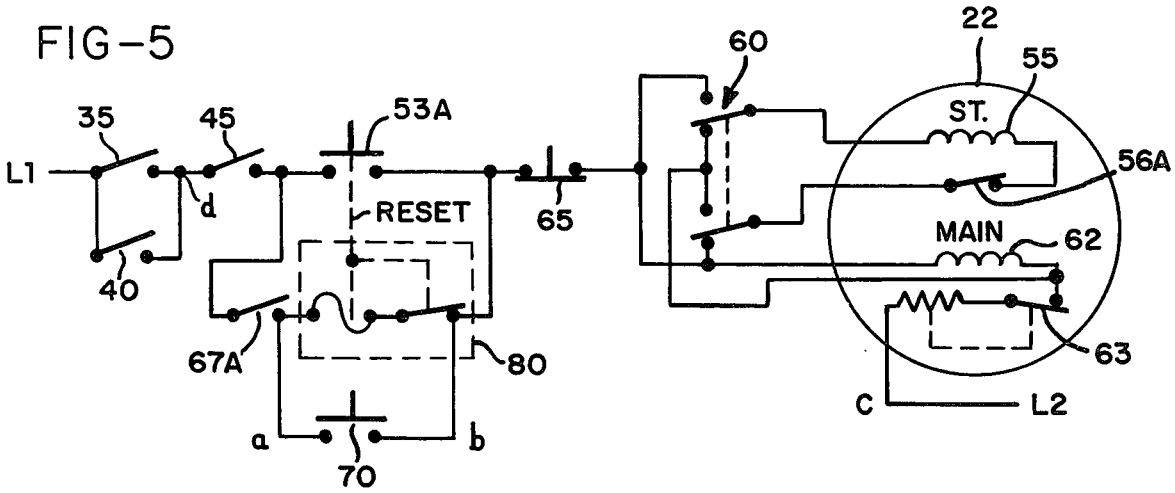

FIG. 5 shows another embodiment of the invention, in which a somewhat different circuit arrangement is provided for producing the desired cycle of operations of the ram. Again, like parts are designated with the same reference numerals as above. In place of the starting relay arrangement, there is a normally open manually operated start switch 53A, and in place of the cycle terminating switch there is a ram operated limit switch 67A, of the normally closed type but held open when the ram is in its fully retracted position, and hence shown in that condition. The ram operated switch is connected in a bypass circuit for the start switch 53A, along with a circuit breaker 80 which is arranged to interrupt the bypass circuit in response to current flow above a predetermined amount. The manually operated selector switch 70 is connected across the circuit breaker. The circuit breaker is of the type which must be manually reset once it opens, and this function is provided by suitable mechanical linkage, shown schematically in FIG. 5, connecting the start switch 53A to the circuit breaker such that reset motion is transferred to the circuit breaker whenever the start switch is manually closed.

With the selector switch open, operation of a cycle is initiated by holding the start switch closed, it being assumed that the key switch 45 is already closed. If the door is properly closed, switch 35 will also be closed, and a forward starting circuit will be completed through the motor. The ram will start to descend in its compacting stroke. Switch 67A will close to bypass the start switch which can then be released and will return to its open position. The interlock bypass switch 40 closes as soon as the ram begins to enter the receptacle, and the direction switch 60 transfers to its reverse position as soon as the ram leaves its fully retracted position, as previously explained. The motor accelerates rapidly, hence the centrifugal switch 56A opens quickly, and the higher starting current for the motor is thus carried only while the start switch is held closed.

The ram descends until the motor stalls and, as before, centrifugal switch 56A closes just before the motor stops. This completes a reverse starting circuit through the direction switch, but the circuit breaker 80 will open in response to the heavier starting current, opening the bypass circuit around the start switch and causing the motor to stop. It has been observed that this occurs almost instantaneously as the motor reverses at the end of the compacting stroke. Thus the ram retracts little, if at all, holding the compaction force on the material in the receptacle. In the manual arrangement shown in FIG. 5, the ram may be retracted at the end of the desired delay, either by depressing the start switch 53A until the motor comes up to speed, which occurs very quickly, or by closing the selector switch 70 since the ram operated switch 67A is closed when the ram is away from its fully retracted position. In either event, the ram will return to its fully retracted position and stop as previously explained. If the selector switch 70 is moved to its closed position it will bypass the circuit breaker 80, and the compactor will function through a normal compacting and retracting cycle.

Figure 6:
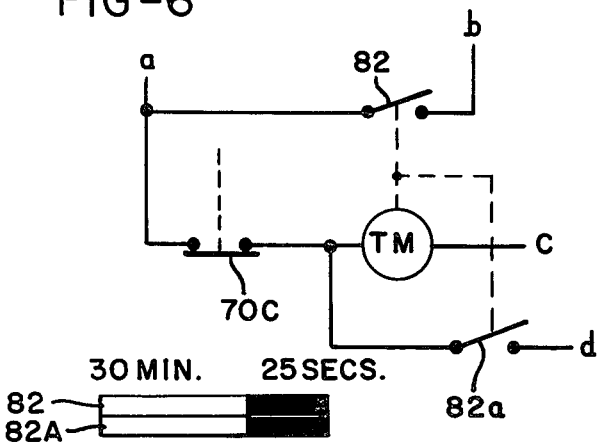

FIG. 6 illustrates how the timed delay function can be added to the circuit of FIG. 5. The lines designated by the numerals *a*, *b*, *c* and *d* can be connected at the points indicated at *a*, *b*, *c* and *d* on FIG. 5. A timer motor TM is connected between the ram operated switch 67A and the power supply line L2. The timer motor circuit is controlled by an extra set of contacts 70C on the selector switch, so that the timer motor is energized only when the selector switch is in its down position. The timer motor controls the timed switch 82 which is connected across the circuit breaker 80, and the switch 82A which is part of the timer reset circuit. When the ram descends, with the selector switch in the down position, the timer motor will start to operate and after a period of time, for example thirty minutes, it will close the timer switch 82. Since switch 67*a* is closed with the ram down, this will supply sufficient starting current to the motor, around the then opened circuit breaker, and the ram will retract. At the point of full retraction, switch 67A will open, thus opening the power supply to the timer motor once the timer is reset and its switch 82A is opened.

While the forms of apparatus herein described constitute preferred embodiments of this invention, it is to be understood that the invention is not limited to these precise forms of apparatus, and that changes may be made therein without departing from the scope of the invention.

What is claimed is:

1. In a trash compacting machine having a receptacle for material to be compacted within a compacting compartment, a door enabling placement of the receptacle within and withdrawal of the receptacle from said compacting compartment, a ram mounted for cyclical movement in a compacting stroke from a starting position outside said receptacle to a compacting position within said receptacle and thereafter in a retracting stroke to its starting position, said ram in its compacting position preventing deposit of trash in said receptacle, a storage compartment associated with said machine adjacent said compacting compartment, an access door for said storage compartment for placement of trash therein, said storage compartment being accessible through said access door to receive and hold trash while said receptacle is within said compacting compartment and said ram is in compacting position within said receptacle and being operable to transfer the held trash into said receptacle when said ram is later moved to said starting position, means for driving said ram through the compacting and retracting strokes including an induction motor having a main winding and a phase reversible starting winding controlled by a starting switch, a control for said motor in which said starting switch has contacts closed when said motor is stopped and further contacts closed when said motor is running, said further contacts being incorporated in the power supply to the mian motor winding such that said motor stops when stalled at the end of a compacting stroke, and a cycle selector switch connected when closed to bypass said further contacts to complete a starting circuit causing a retracting stroke of the ram, said cycle selector switch providing a selection between complete cycle operation and an interrupted cycle in which said ram is stopped at the end of its compacting stroke.

2. A trash compacting machine as defined in claim 1, including a time delay switch connected when closed to complete a starting circuit bypassing said further contacts to start said motor after a delay at the end of a compacting stroke.

3. In a trash compacting machine having a receptacle for material to be compacted within a compacting compartment, a door enabling placement of the receptacle within and withdrawal of the receptacle from said compacting compartment, a ram mounted for cyclical movement in a compacting stroke from a starting position outside said receptacle to a compacting position within said receptacle and thereafter in a retracting stroke to its starting position, said ram in its compacting position preventing deposit of trash in said receptacle, a storage compartment associated with said machine adjacent said compacting compartment, an access door for said storage compartment for placement of trash therein, said storage compartment being accessible through said access door to receive and hold trash while said receptacle is within said compacting compartment and said ram is in compacting position within said receptacle and being operable to transfer the held trash into said receptacle when said ram is later moved to said starting position, means for driving said ram through the compacting and retracting strokes including an induction motor having a main winding and a phase reversible starting winding, a control for said motor including a reversing switch having reversing contacts which control the phase connection of said starting winding and which close when said motor is running to drive said ram in a compacting stroke, said control also incorporating means to interrupt the power supply to said reversing switch at the end of a compacting stroke such that said motor stops when stalled at the end of a compacting stroke, and a cycle selector switch connected when closed to bypass said interrupting means to complete a starting circuit causing a retracting stroke of the ram as soon as the ram reaches the end of a compacting stroke, said cycle selector switch providing a selection between complete cycle operation and an interrupted cycle in which said ram is stopped at the end of its compacting stroke.

4. A trash compacting machine as defined in claim 3, including time delay means having normally open contacts connected when closed to bypass said cycle selector switch when it is open, and means for initiating operation of said time delay means to close its open contacts after a predetermined delay following the end of a compacting stroke.

* * * * *